US008783818B2

(12) United States Patent
Yamada et al.

(10) Patent No.: US 8,783,818 B2
(45) **Date of Patent: *Jul. 22, 2014**

(54) RECORDING APPARATUS WITH ULTRAVIOLET LIGHT IRRADIATION UNIT

(75) Inventors: Akira Yamada, Matsumoto (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

This patent is subject to a terminal disclaimer.

(21) Appl. No.: 13/305,651

(22) Filed: Nov. 28, 2011

(65) Prior Publication Data

US 2012/0139993 A1 Jun. 7, 2012

(30) Foreign Application Priority Data

Dec. 2, 2010 (JP) ..... 2010-269428

(51) Int. Cl.
*B41J 29/393* (2006.01)

(52) U.S. Cl.
USPC ..... 347/19; 347/102

(58) Field of Classification Search
USPC ..... 347/9, 14, 19, 23, 44, 47, 101, 102, 347/106, 100
See application file for complete search history.

(56) References Cited

U.S. PATENT DOCUMENTS

| | | | | |
|---|---|---|---|---|
| 6,783,227 | B2 | 8/2004 | Suzuki et al. | |
| 7,393,095 | B2 | 7/2008 | Oshima et al. | |
| 8,500,235 | B2 * | 8/2013 | Usuda | 347/19 |
| 2005/0168509 | A1 | 8/2005 | Yokoyama | |
| 2005/0168555 | A1 | 8/2005 | Nickawa | |

FOREIGN PATENT DOCUMENTS

| | | |
|---|---|---|
| JP | 2004-160875 | 6/2004 |
| JP | 2004-314304 | 11/2004 |
| JP | 2005-104108 | 4/2005 |
| JP | 2005-212415 | 8/2005 |
| JP | 2005-246955 | 9/2005 |
| JP | 2009-101632 | 5/2009 |
| JP | 2010-234818 | 10/2010 |

* cited by examiner

*Primary Examiner* — Juanita D Jackson
(74) *Attorney, Agent, or Firm* — Workman Nydegger

(57) ABSTRACT

A recording apparatus including a recording head that discharges UV ink onto a recording material and an ultraviolet light irradiation unit that irradiates ultraviolet light to the discharged UV ink so as to harden the UV ink; further includes a failure diagnostic unit that diagnoses a failure condition of the ultraviolet light irradiation unit and a controller that controls operations of the recording head, the ultraviolet light irradiation unit, and the failure diagnostic unit. Further, the controller is so configured as to change the operation mode of the recording apparatus to a failure-state mode when the ultraviolet light irradiation unit has been diagnosed as a failure by the failure diagnostic unit.

7 Claims, 4 Drawing Sheets

RECORDING APPARATUS WITH ULTRAVIOLET LIGHT IRRADIATION UNIT

INCORPORATION BY REFERENCE

This application claims the benefit of Japanese Patent Application No. 2010-269428, filed on Dec. 2, 2010, which is incorporated by reference here in its entirety.

BACKGROUND

1. Technical Field

The present invention relates to a recording apparatus that includes a recording head which discharges ultraviolet (UV) ink, which is hardened by irradiation of ultraviolet light, onto a recording material and an ultraviolet light irradiation unit that irradiates ultraviolet light to the discharged UV ink so as to harden the UV ink.

2. Related Art

This type of recording apparatus, that is, a recording apparatus of the past technique equipped with an ultraviolet light irradiation unit that hardens UV ink is disclosed in JP-A-2010-234818.

The recording apparatus described in JP-A-2010-234818 includes a recording head that discharges UV ink onto a recording material and an ultraviolet light irradiation unit that irradiates ultraviolet light to the discharged UV ink so as to harden the UV ink. A metal halide lamp, a light emitting diode (LED), and the like are mentioned therein as an ultraviolet light irradiation unit.

As an ultraviolet light irradiation unit having excellent durability is selected and used from a design viewpoint, it can be said that a risk of failure occurrence is low. However, it is quite difficult to completely prevent the occurrence of a failure.

An ultraviolet light irradiation unit hardly becomes out of order; however, if recording operation is performed by discharging UV ink from a recording head onto a recording material in a state in which the ultraviolet light irradiation unit is out of order, the UV ink will remain unhardened because ultraviolet light is not irradiated to the discharged UV ink. As a result, the recording material and the UV ink will be wasted. In addition, the members forming a recording material transport path, a recording execution region, and the like of a recording apparatus are contaminated by the unhardened UV ink, which may bring about a serious trouble that cannot be settled only by taking out the recording material from the recording apparatus. That is to say, all the contaminated members will have to be decontaminated by cleaning, and the cleaning is expected to be large-scale work including dismantling of the apparatus in general.

In the case where the ultraviolet light irradiation unit has a structure in which a plurality of LEDs are used, if any one of the LEDs becomes out of order, UV ink that corresponds to the failed LED will remain unhardened. Therefore, although UV ink that corresponds to the healthy LEDs other than the failed one is hardened, the recording material that has been recorded on cannot be used as a recorded object, and the problem that the recording material and UV ink are wasted arises as in the case mentioned above. Furthermore, although a range of area contaminated by the unhardened UV ink is relatively small, there exists a problem such that the work to decontaminate the contaminated members by cleaning cannot be avoided.

In the case where the ultraviolet light irradiation unit is configured of, for example, a single metal halide lamp, a user can easily recognize the occurrence of a failure of the lamp. In contrast, in the case where the ultraviolet light irradiation unit has a structure in which a plurality of LEDs are used, if any one of the plurality of LEDs becomes out of order, the user is unlikely to recognize the occurrence of the failure of the LED. Accordingly, in this case, there may exist a large risk such that the aforementioned problems due to the failure will arise.

SUMMARY

An advantage of some aspects of the invention is to prevent recording material and UV ink from being wasted due to a failure of an ultraviolet light irradiation unit and also prevent a problem of contamination of the members configuring a recording apparatus caused by unhardened UV ink from arising.

A recording apparatus according to a first aspect of the invention includes: a recording head that discharges UV ink onto a recording material; an ultraviolet light irradiation unit that irradiates ultraviolet light to the discharged UV ink so as to harden the UV ink; a failure diagnostic unit that diagnoses a failure condition of the ultraviolet light irradiation unit; and a controller that controls operations of the recording head, the ultraviolet light irradiation unit, and the failure diagnostic unit. Further, the controller is so configured as to change the operation mode of the recording apparatus to a failure-state mode when the ultraviolet light irradiation unit has been diagnosed as a failure by the failure diagnostic unit.

It is to be noted that "diagnoses a failure condition" means that the failure diagnostic unit detects and judges if the ultraviolet light irradiation unit is in a state in which it cannot irradiate the ultraviolet light to harden the UV ink.

It is also to be noted that "failure-state mode" is an operation mode, that is, presetting for a case of failure, to which the state of the recording apparatus is shifted so as to prevent the problem of wasting and contamination from arising when the ultraviolet light irradiation unit is out of order.

According to this aspect, the recording apparatus is so configured as to change the operation mode of the apparatus to a failure-state mode when the failure diagnostic unit has diagnosed a failure condition of the ultraviolet light irradiation unit and the ultraviolet light irradiation unit has been diagnosed as a failure by the failure diagnostic unit.

Accordingly, it is possible to avoid the execution of recording operation in a regular manner in a state in which the ultraviolet light irradiation unit is out of order. As a result, the waste of recording material and UV ink due to the failure of the ultraviolet light irradiation unit is prevented from occurring and the problem of contamination of the members configuring the apparatus caused by the unhardened UV ink can be prevented from arising.

According to a second aspect of the invention, it is preferable that, in the recording apparatus according to the first aspect, the failure diagnostic unit perform failure diagnostics before starting the execution of recording operation by the recording head, and the controller be so configured as to change the operation mode of the recording apparatus to a first failure-state mode when the ultraviolet light irradiation unit has been diagnosed as a failure by the failure diagnostic unit.

Note that "first failure-state mode" is, among the failure-state modes mentioned above, an operation mode in a case of failure, to which the state of the recording apparatus is shifted when the failure diagnostics has been performed before starting the execution of recording operation by the recording head and the ultraviolet light irradiation unit has been diagnosed as a failure.

According to this aspect, since the failure diagnostics is performed before starting the execution of recording operation, the waste of recording material and UV ink due to a failure of the ultraviolet light irradiation unit is effectively prevented.

According to a third aspect of the invention, it is preferable that, in the recording apparatus according to the second aspect, the first failure-state mode be an operation mode in which failure information is notified without starting the execution of recording operation.

According to this aspect, since a user can easily recognizes the occurrence of a failure, the same operational effect as in the second aspect can be achieved and the following processing to cope with the failure can be promptly carried out.

According to a fourth aspect of the invention, it is preferable that, in the recording apparatus according to any one of the first through third aspects, the failure diagnostic unit perform the failure diagnostics during the execution of recording operation by the recording head, and the controller be so configured as to change the operation mode of the recording apparatus to a second failure-state mode when the ultraviolet light irradiation unit has been diagnosed as a failure by the failure diagnostic unit.

Note that "second failure-state mode" is, among the failure-state modes mentioned above, an operation mode in a case of failure, to which the state of the recording apparatus is shifted when the failure diagnostics has been performed during the execution of recording operation by the recording head and the ultraviolet light irradiation unit has been diagnosed as a failure.

According to this aspect, since the failure diagnostics is performed during the execution of recording operation, recording in unhardened UV ink is effectively prevented from occurring. In addition, the following processing to cope with the failure can be promptly carried out. Accordingly, the waste of recording material and UV ink due to a failure of the ultraviolet light irradiation unit can be effectively prevented, and the problem of contamination of the members configuring the apparatus caused by unhardened UV ink can be effectively prevented from arising.

According to a fifth aspect of the invention, it is preferable that, in the recording apparatus according to the fourth aspect, the second failure-state mode be one of:

(1) an operation mode in which the executing recording operation is switched to an alternative recording mode and the recording is continued;

(2) an operation mode in which the executing recording operation is stopped; and (3) an operation mode of either (1) or (2), which is previously selected and determined by a user.

Note that "alternative recording mode" is an operation mode that substitutes for a recording operation mode having been adopted before the occurrence of a failure, and in which the recording is continued in an operation state where the quality of recording is equivalent to or the second best to the quality of recording before the occurrence of the failure so as to choose completion of the recording rather than stop the recording.

According to this aspect, in the case where the failure diagnostics is performed during the execution of recording operation and the ultraviolet light irradiation unit is diagnosed as a failure, when the configuration of the apparatus is such that the recording is continued in the alternative recording mode (the operation mode described at (1)), a complete recording product can be obtained even if the failure has occurred in the ultraviolet light irradiation unit. Accordingly, it is possible to perform recording operation in which completion of the recording is prioritized, thereby improving usability of the recording apparatus.

On the other hand, in the case where the failure diagnostics is performed during the execution of recording operation and the ultraviolet light irradiation unit is diagnosed as a failure, when the configuration of the apparatus is such that the apparatus is shifted to the operation mode described at (2), the waste of recording material and UV ink due to the failure of the ultraviolet light irradiation unit that has occurred during the execution of recording operation is effectively prevented.

Furthermore, when the operation process of the apparatus is previously selected and determined by the user (the operation mode described at (3)), user-friendliness of the recording apparatus is improved to be more user-friendly because the operation mode is selected following the intention of the user.

According to a sixth aspect of the invention, it is preferable that the recording apparatus according to the fifth aspect further include: a transport device that transports the recording material so as to make it pass through a recording execution region of the recording head; and a carriage that holds the recording head and the ultraviolet light irradiation unit and moves back and forth in the direction that intersects with the transport direction. It is also preferable that the ultraviolet light irradiation unit include at least one row in which a plurality of LEDs are arranged in the transport direction.

In the case where the ultraviolet light irradiation unit has a structure in which a plurality of LEDs are used, when a failure occurs in one of the plurality of LEDs, a user is unlikely to recognize the failure.

However, according to this aspect, since the failure diagnostic unit diagnoses a failure condition of the ultraviolet light irradiation unit, the occurrence of a failure can be easily recognized even if only one of the plurality of LEDs becomes out of order. Therefore, even in the case where the ultraviolet light irradiation unit has a structure in which a plurality of LEDs are used, the waste of recording material and UV ink due to a failure of the LED is effectively prevented, and the problem of contamination of the members configuring the apparatus caused by unhardened UV ink can be effectively prevented from arising.

According to a seventh aspect of the invention, it is preferable that, in the recording apparatus according to any one of the fourth through sixth aspects, the failure diagnostic unit be so configured as to perform the failure diagnostics at the time of maintenance operation during the execution of recording operation by the recording head.

According to this aspect, it is possible to effectively diagnose a failure condition of the ultraviolet light irradiation unit with ease without changing the structure of the apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the configuration of a recording apparatus of the invention and the action of the recording apparatus will be specifically described while exemplifying a first embodiment and a second embodiment shown in FIGS. 1 and 2, and a third embodiment shown in FIG. 3.

Figure 1:
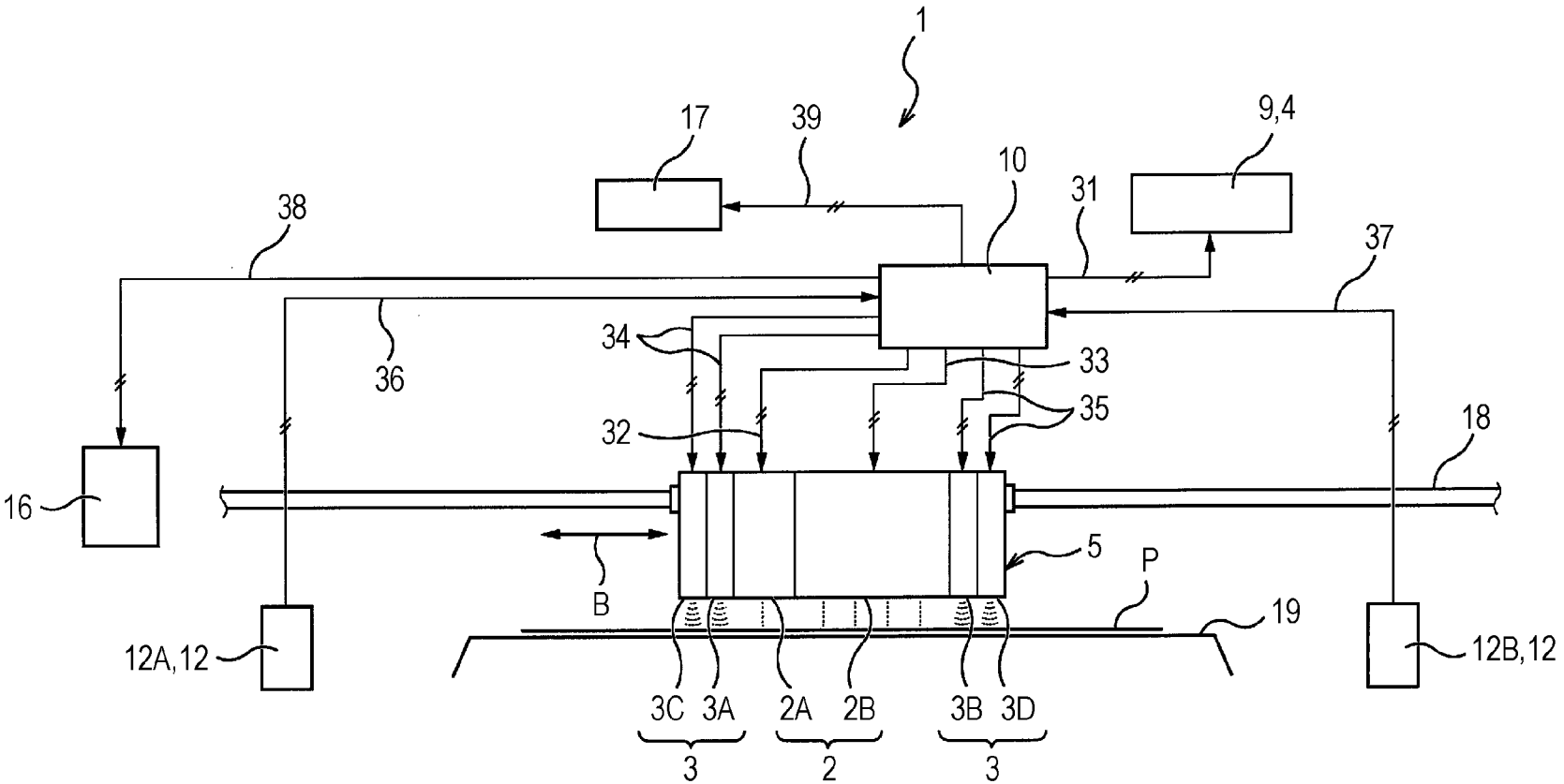
FIG. 1 is a main portion elevation view schematically illustrating the configuration of the inner structure of a recording apparatus according to a first embodiment and a second embodiment of the invention.
Figure 2:
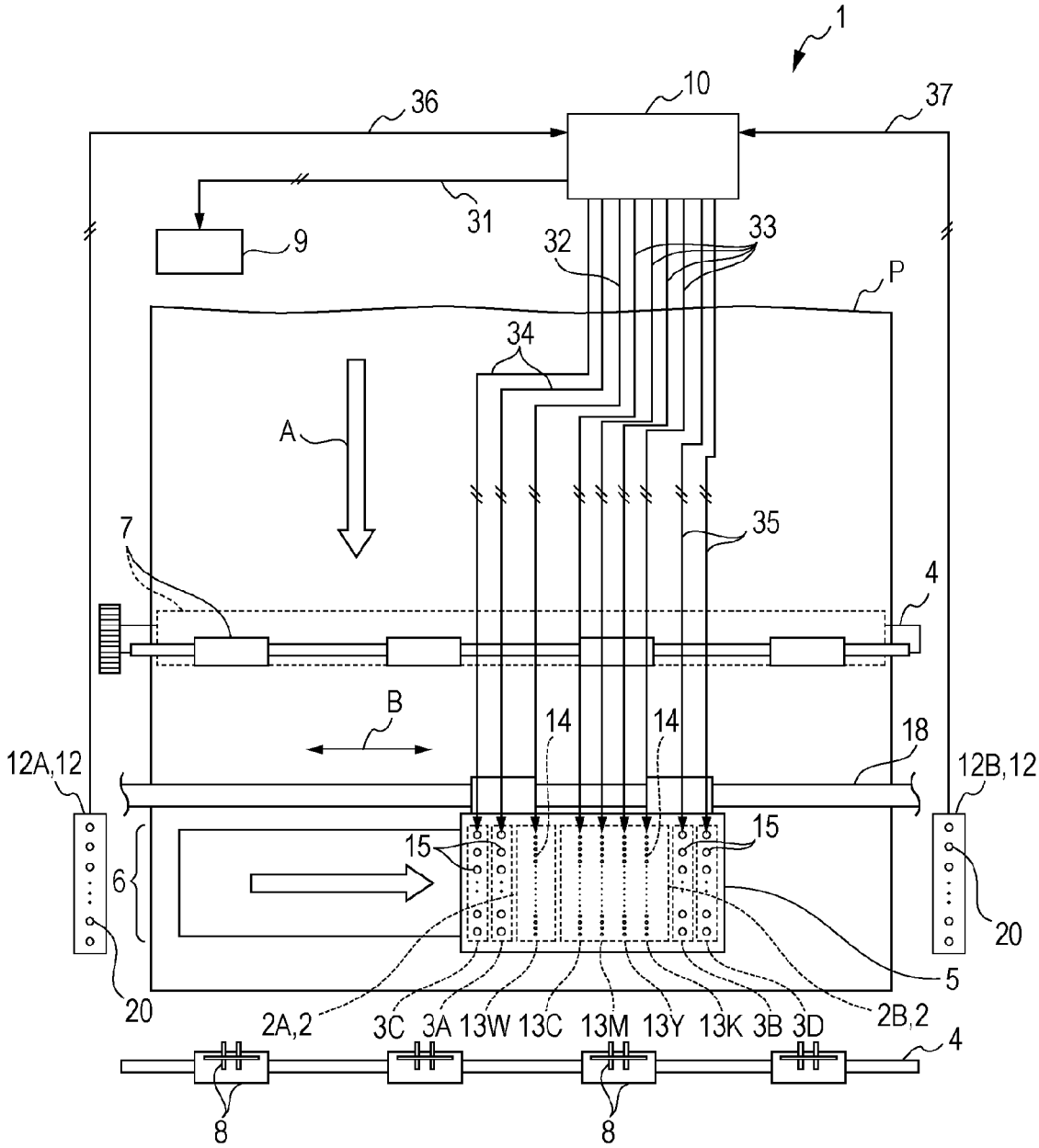
FIG. 2 is a main portion plan view schematically illustrating the configuration of the inner structure of a recording apparatus according to the first embodiment and the second embodiment of the invention.
Figure 4:
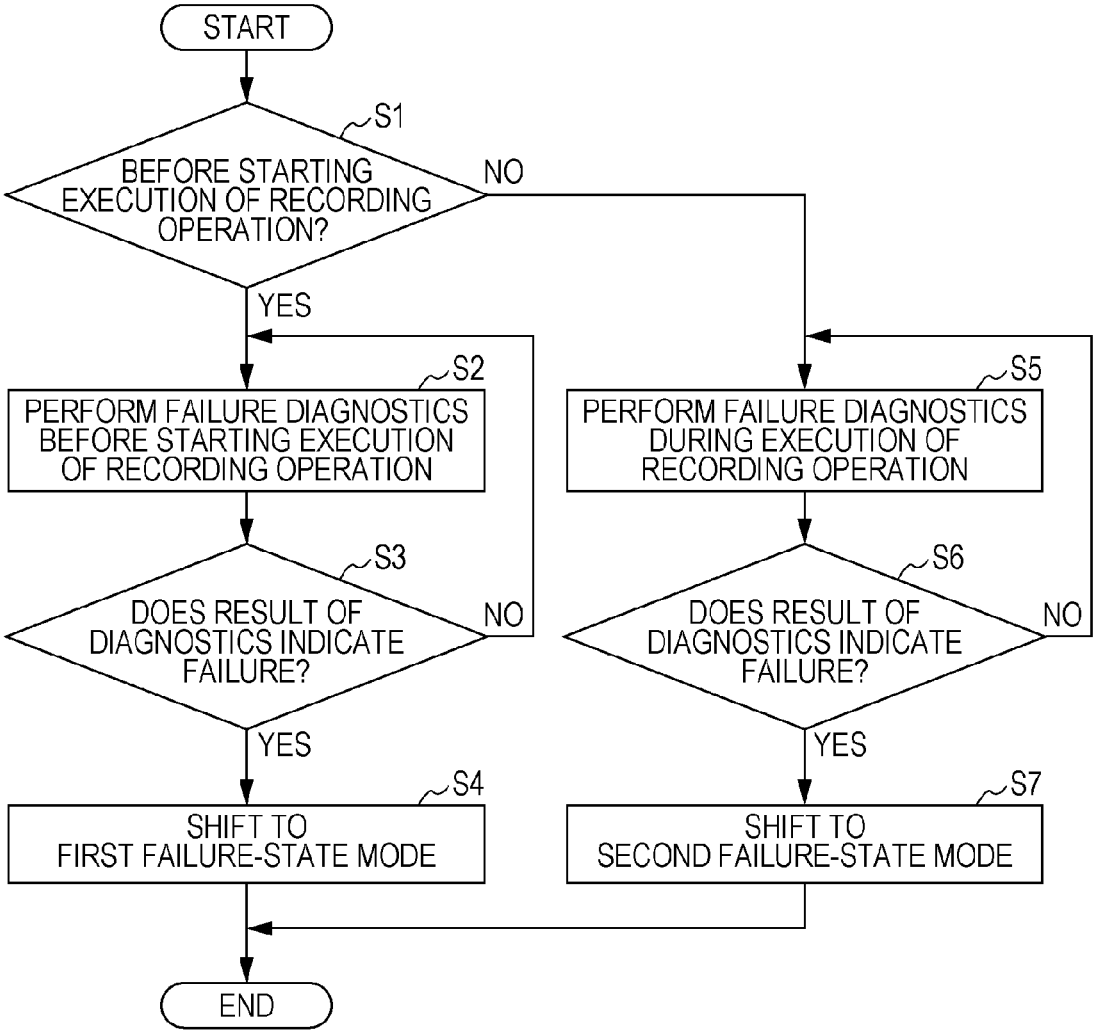
FIG. 4 is a descriptive flowchart indicating the action of a recording apparatus according to the first embodiment and the second embodiment of the invention.

First Embodiment, see FIGS. 1, 2, and 4

A recording apparatus 1 shown in the drawings is an ink jet printer 1 (the same numerals as in the "recording apparatus" are used). The ink jet printer 1 includes a recording head 2 that discharges UV ink onto a recording material (hereinafter, also called "paper") P and an ultraviolet light irradiation unit 3 that irradiates ultraviolet light to the discharged UV ink so as to harden the UV ink. In addition, the ink jet printer 1 further includes a failure diagnostic unit 12 that diagnoses a failure condition of the ultraviolet light irradiation unit 3, and a controller 10 that controls operations of the recording head 2, the ultraviolet light irradiation unit 3 and the failure diagnostic unit 12.

Further, in this embodiment, the ink jet printer 1 has a transport device 4 that transports the recording material P in a transport direction A so as to make the recording material P pass through a recording execution region of the recording head 2, and a carriage 5 that holds the recording head 2 and the ultraviolet light irradiation unit 3 and moves back and forth in a direction B intersecting with the transport direction A. Furthermore, the controller 10 is so configured as to control operations of the transport device 4 and the carriage 5.

The transport device 4 is configured of, for example, a transport roller 7 formed by a pair of nip rollers that is provided at a position upstream in the transport direction A from a recording execution region 6, and a discharge roller 8 also formed by a pair of nip rollers that is provided at a position downstream from the recording execution region 6.

Further, the apparatus is configured so that a transport signal 31, which instructs the transport in a predetermined amount, is transmitted from the controller 10 to a motor 9 (see FIG. 1) that drives the transport roller 7 and the discharge roller 8, and the paper P is intermittently transported by the predetermined amount.

It should be noted that the transport device 4 transports the recording material P in two different transport manners in which the recording material P is intermittently transported by a band transporting amount so as to perform a high speed recording, and by an amount less than the band transporting amount so as to perform a high image-quality recording. The transport device 4 transports the recording material P while adequately switching between the two transport manners.

In this specification, "band" means a recording execution region or a recorded region whose width corresponds to the length of a nozzle row 13 in alignment with the transport direction A of the recording material P.

Further, "band transporting amount" is a transport amount by which the recording material P is actually transported when the recording on each of the bands is performed.

The recording head 2, in this embodiment, is provided with a first recording head 2A that discharges ground-forming UV ink and a second recording head 2B that discharges image-forming UV ink. For example, the first recording head 2A is disposed on the left side in FIGS. 1 and 2, whereas the second recording head 2B is disposed on the right side in FIGS. 1 and 2.

The first recording head 2A is provided with a nozzle row 13W that ejects ground-forming ink of colors such as white (W), gold (G), silver (S) and so on. On the other hand, the second recording head 2B is provided, for example, with four nozzle rows 13C, 13M, 13Y and 13K that are arranged in parallel to each other with predetermined intervals in a movement direction B and respectively eject four image-forming inks of cyan (C), magenta (M), yellow (Y) and black (K). Note that numeral 14 in FIG. 2 indicates an ink discharge nozzle forming the nozzle row 13.

Note that the term "image" in "image-forming UV ink" is used in a broad sense such as recording information including pictures, text, and so on in this specification.

The controller 10 transmits ink discharge signals 32, 33 that instruct ink discharge amounts to the nozzle rows 13W, 13C, 13M, 13Y, 13K so as to regulate the ink discharge amounts.

Further, in the ink jet printer 1 shown in the drawings, the ink discharged through each of the nozzles 14 in the nozzle rows 13W, 13C, 13M, 13Y, 13K is "UV ink" that is hardened by the irradiation of UV light (ultraviolet light).

"UV ink" is an ink that is hardened and fixed by the irradiation of UV light (ultraviolet light) and exhibits excellence in quick hardening. In addition, the rate of volume contraction of the UV ink after being hardened is much smaller than that of pigment ink of the past technique that is dried and fixed by making a heater heat and evaporate a solvent.

Furthermore, "UV ink" is eco-friendly because it does not contain a soluble component, and is suited to be used for recording on the recording material P of a film-type with low ink absorbability because it is instantly hardened by the irradiation of UV light (ultraviolet light).

The carriage 5 is a back-and-forth transport unit for the recording head 2 that moves back and forth in the movement direction B along a carriage guide shaft 18 extending in the movement direction B.

A driving force to move the carriage 5 back and forth is given by a motor 16 that is capable of forward-reverse rotation and can precisely control each unit step of the carriage movement. The rotation of the motor 16 is transmitted to the carriage 5 via a toothed belt (not shown). The motor 16 rotates upon receiving a motor control signal 38 from the controller 10.

Note that numeral 19 in the drawings indicates a support member of the recording material P.

The ultraviolet light irradiation unit 3 is equipped with a first ultraviolet light irradiation unit 3A and a second ultraviolet light irradiation unit 3B. The main role of the first ultraviolet light irradiation unit 3A is to harden the ground-forming UV ink discharged onto the recording material P from the first recording head 2A; the first ultraviolet light irradiation unit 3A is disposed in the vicinity of the left side of the first recording head 2A in the drawing. On the other hand, the main role of the second ultraviolet light irradiation unit 3B is to harden the image-forming UV ink discharged from the second recording head 2B; the second ultraviolet light irradiation unit 3B is disposed in the vicinity of the right side of the second recording head 2B in the drawing.

In this embodiment, the ultraviolet light irradiation unit 3 is further equipped with a third ultraviolet light irradiation unit 3C and a fourth ultraviolet light irradiation unit 3D. The third ultraviolet light irradiation unit 3C is provided as a backup of the first ultraviolet light irradiation unit 3A, meanwhile the fourth ultraviolet light irradiation unit 3D is provided as a backup of the second ultraviolet light irradiation unit 3B.

In the four ultraviolet light irradiation units, i.e., the first ultraviolet light irradiation unit 3A, second ultraviolet light irradiation unit 3B, third ultraviolet light irradiation unit 3C and fourth ultraviolet light irradiation unit 3D, a plurality of LEDs 15 are arranged and provided in alignments corresponding to alignments of the nozzles 14 in the nozzle rows 13W, 13C, 13M, 13Y, 13K of the two recording heads 2A and 2B. Note that the layout of the LEDs 15 and the nozzles 14 is schematically illustrated to avoid complexity of the drawing; however, in reality, each single LED 15 is disposed at a position from which the single LED 15 can irradiate the ultraviolet light to a series of 30 to 50 in number of the nozzles 14, for example. Although, in this embodiment, the plurality of LEDs 15 are arranged in a row in alignment with the transport direction A, it is needless to say that the plurality of LEDs 15 can be arranged in one or more rows.

To these LEDs 15, the controller 10 transmits UV light irradiation signals 34 and 35, which instruct the amounts of UV light (ultraviolet light) to be irradiated at the positions corresponding to the LEDs 15, so as to regulate the amounts of UV light (ultraviolet light) irradiation.

The failure diagnostic unit 12 is a unit that diagnoses a failure condition of the ultraviolet light irradiation unit 3. In this embodiment, the unit is configured of a first failure diagnostic unit 12A and a second failure diagnostic unit 12B that are respectively provided on either side of the back-and-forth movement direction of the recording head 2. The first failure diagnostic unit 12A and second failure diagnostic unit 12B have light receivers 20 that are provided at positions opposing each of the LEDs 15 in the ultraviolet light irradiation unit 3. Each of the light receivers 20 detects the amount of ultraviolet light irradiated from each of the LEDs 15. If the detected amount of ultraviolet light irradiation is less than a predetermined value, the LED 15 corresponding to the detected amount of ultraviolet light irradiation is diagnosed as a "failure," and failure diagnostics signals 36, 37 as a result of the diagnostics are transmitted to the controller 10.

It is to be noted that a specific structure of the failure diagnostic unit 12 is not limited to the structure including the light receivers 20; for example, the "failure" of the LED 15 can be diagnosed through detecting fluctuations in values of a voltage and a current of the ultraviolet light irradiation unit 3.

The controller 10 is so configured as to change the operation mode of the ink jet printer 1 to a failure-state mode when the ultraviolet light irradiation unit 3 has been diagnosed as a failure by the first failure diagnostic unit 12A or the second failure diagnostic unit 12B. Here, "failure-state mode" is, as described earlier, an operation mode, preset for a case of failure, to which the state of the recording apparatus is shifted so as to prevent the waste of ink, recording material and the like, and also prevent the problem of contamination of the transport device 4 caused by unhardened UV ink from arising, when the ultraviolet light irradiation unit 3 becomes out of order.

In addition, a failure notification unit 17 is connected to the controller 10, and failure information is notified to a user by the failure notification unit 17.

Next, the action of the embodiment will be described with reference to a flowchart in FIG. 4.

At first, it is judged at step S1 whether or not the recording operation has been got started. If it is judged that the recording operation has not been got started yet, the process goes to step S2 in which the failure diagnostics is performed by the failure diagnostic unit 12 before starting the execution of recording operation, then proceeds to step S3. If it is determined at step S3 that the result of the diagnostics indicates a failure, the process goes to step S4 in which the recording apparatus 1 is shifted to a first failure-state mode. If it is determined at step S3 that the result of the diagnostics does not indicate a failure, the process goes back to step S2.

Note that the "first failure-state mode" is, among the failure-state modes mentioned earlier, an operation mode in a case of failure, to which the state of the recording apparatus 1 is shifted when the failure diagnostics has been performed before starting the execution of recording operation by the recording head 2 and the ultraviolet light irradiation unit 3 has been diagnosed as a failure. Furthermore, here in the embodiment, an operation mode in which failure information is notified to a user by the failure notification unit 17 without starting the recording operation is adopted as the first failure-state mode.

According to this embodiment, it is possible to avoid the execution of recording operation in a regular manner in a state in which the ultraviolet light irradiation unit 3 is out of order. As a result, the waste of the recording material P and UV ink due to a failure of the ultraviolet light irradiation unit 3 is prevented and the problem of contamination of the members configuring the apparatus caused by unhardened UV ink can be prevented from arising.

Further, since the failure diagnostics is performed before starting the execution of recording operation, the waste of recording material and UV ink due to a failure of the ultraviolet light irradiation unit 3 can be effectively prevented. In addition, since a user can easily recognize the occurrence of a failure by the notification from the failure notification unit 17, processing to cope with the failure can be promptly started.

Second Embodiment, see FIGS. 1, 2, 4

In a second embodiment of the invention, the failure diagnostic unit 12 performs failure diagnostics during the execution of recording operation by the recording head 2, and the controller 10 changes the operation mode of the recording apparatus 1 to a second failure-state mode when the ultraviolet light irradiation unit 3 has been diagnosed as a failure by the failure diagnostic unit 12.

Note that the "second failure-state mode" is, as described earlier, among the failure-state modes, an operation mode in a case of failure, to which the state of the recording apparatus 1 is shifted when the failure diagnostics has been performed during the execution of recording operation by the recording head 2 and the ultraviolet light irradiation unit 3 has been diagnosed a failure.

Note that the second failure-state mode is either one of the following operation modes:

(1) an operation mode in which the executing recording operation is switched to an alternative recording mode and the recording is continued;

(2) an operation mode in which the executing recording operation is stopped; and (3) an operation mode of either (1) or (2), which is previously selected and determined by a user.

Note that the "alternative recording mode" is, as described earlier, an operation mode that substitutes for a recording operation mode having been adopted before the occurrence of a failure, and in which the recording is continued in an operation state where the quality of recording is equivalent to or the second best to the quality of recording before the occurrence of the failure so as to choose completion of the recording.

Specifically, if the first ultraviolet light irradiation unit 3A becomes out of order, the use of the first ultraviolet light irradiation unit 3A is stopped and the third ultraviolet light irradiation unit 3C is used instead, then the recording is continued. Meanwhile, if the second ultraviolet light irradiation unit 3B becomes out of order, the use of the second ultraviolet light irradiation unit 3B is stopped and the fourth ultraviolet light irradiation unit 3D is used instead, then the recording is continued. Accordingly, the recording can be continued while the quality of recording is maintained equivalent to the quality before the occurrence of the failure.

In the case where any one of the LEDs becomes out of order, in order to continue the recording, the apparatus is switched to a transport mode in which the row of the LEDs including the failed LED is separated into two sides at the position of the failed LED so as to use a series of LEDs only on the side that has healthy LEDs more than the other, and the operation of ink discharge is made to adjust with this situation. In this case, the quality of recording is not equivalent to, but is the second best to the quality of recording before the occurrence of the failure; however, as long as the user's requirement to the quality of recording is satisfied, the recording in this mode can be continued.

Next, the action of the embodiment will be described with reference to the flowchart in FIG. 4.

At first, if it is judged at step S1 that the recording operation has been got started and in execution, not that prior to execution of the recording operation, the process goes to step S5 in which the failure diagnostics is performed by the failure diagnostic unit 12 during the execution of recording operation, then proceeds to step S6. If it is determined at step S6 that the result of the diagnostics indicates a failure, the process goes to step S7 in which the recording apparatus 1 is shifted to the second failure-state mode. If it is determined at step S6 that the result of the diagnostics does not indicate a failure, the process goes back to step S5.

In the case where the recording is continued in the alternative recording mode mentioned above in the "second failure-state mode," a finished recording product having the quality of recording which is equivalent to or the second best to the quality before the occurrence of the failure can be obtained even if the failure has occurred in the ultraviolet light irradiation unit 3. Accordingly, recording operation in which completion of the recording is chosen can be performed, and usability of the recording apparatus is improved.

Furthermore, in the case where the failure diagnostics has been performed during the execution of recording operation and the ultraviolet light irradiation unit 3 has been diagnosed as a failure, if the apparatus is shifted to the operation mode of (2) described above in which the recording operation is stopped, a finished recording product cannot be obtained. However, in this case, the waste of recording material and UV ink due to the failure of the ultraviolet light irradiation unit 3 that has occurred during the execution of recording operation can be prevented from being further increased in quantity.

In the case where the ultraviolet light irradiation unit 3 has a structure in which the plurality of LEDs 15 are used, when a failure occurs in one of the plurality of LEDs 15, a user is unlikely to recognize the occurrence of the failure.

According to the aforementioned embodiments, as the failure diagnostic unit 12 diagnoses a failure condition of the ultraviolet light irradiation unit 3, the occurrence of a failure can be easily found out even if only one of the plurality of LEDs 15 becomes out of order. Accordingly, in the case where the ultraviolet light irradiation unit 3 has a structure in which the plurality of LEDs 15 are used, it is possible to effectively prevent the waste of the recording material P and UV ink due to a failure of the LED 15, and also effectively prevent the problem of contamination of the members configuring the apparatus caused by unhardened UV ink from arising.

Further, if the failure diagnostic unit 12 is so configured as to perform failure diagnostics at the time of maintenance operation in which a nozzle recovery processing and the like are carried out during the execution of recording operation by the recording head 2, the diagnostics of a failure condition of the ultraviolet light irradiation unit 3 can be performed with ease without changing the structure of the apparatus.

Figure 3:
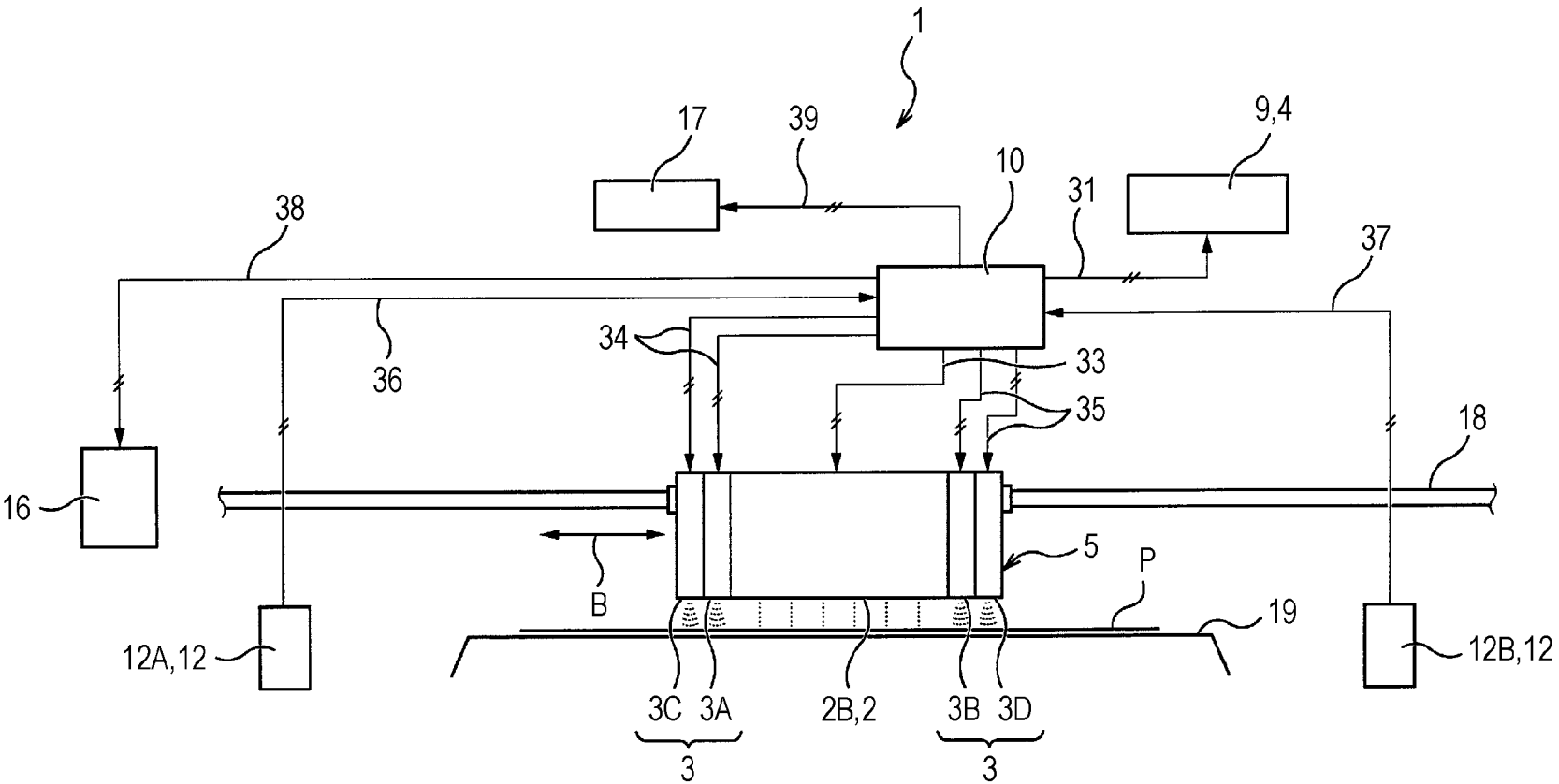
FIG. 3 is a main portion elevation view schematically illustrating the configuration of the inner structure of a recording apparatus according to a third embodiment of the invention.

Third Embodiment, see FIG. 3

A recording apparatus 1 according to a third embodiment of the invention, in principle, is based on the configuration that is similar to the configuration mentioned thus far. However, needless to say, it is also possible to modify or omit part of the configuration without departing from the spirit and scope of the invention.

For example, as shown in FIG. 3, it is advisable that a recording head 2 is configured only by a second recording head 2B that discharges image-forming UV ink. With this structure, ground-recording (ground-forming) operation as described in the aforementioned embodiment cannot be performed. However, it is possible to use this structure in a case where a recording material does not need the ground-recording.

What is claimed is:

1. A recording apparatus comprising:

a recording head that discharges UV ink onto a recording material;

an ultraviolet light irradiation unit that irradiates ultraviolet light to the discharged UV ink so as to harden the UV ink; and further includes:

a failure diagnostic unit that diagnoses a failure condition of the ultraviolet light irradiation unit; and a controller that controls operations of the recording head, the ultraviolet light irradiation unit, and the failure diagnostic unit, wherein the controller is so configured as to change an operation mode of the recording apparatus to a failure-state mode when the ultraviolet light irradiation unit has been diagnosed as a failure by the failure diagnostic unit.

2. The recording apparatus according to claim 1, wherein the failure diagnostic unit performs failure diagnostics before starting the execution of recording operation by the recording head, and the controller is so configured as to change the operation mode of the recording apparatus to a first failure-state mode when the ultraviolet light irradiation unit has been diagnosed as a failure by the failure diagnostic unit.

3. The recording apparatus according to claim 2, wherein the first failure-state mode is an operation mode in which failure information is notified without starting the execution of recording operation.

4. The recording apparatus according to claim 1, wherein the failure diagnostic unit performs the failure diagnostics during the execution of recording operation by the recording head, and the controller is so configured as to change the operation mode of the recording apparatus to a second failure-state mode when the ultraviolet light irradiation unit has been diagnosed as a failure by the failure diagnostic unit.

5. The recording apparatus according to claim 4, wherein the second failure-state mode is one of:

(1) an operation mode in which the executing recording operation is switched to an alternative recording mode and the recording is continued;

(2) an operation mode in which the executing recording operation is stopped; and (3) an operation mode of either (1) or (2), which is previously selected and determined by a user.

6. The recording apparatus according to claim 5, further including:

a transport device that transports the recording material so as to make the recording material pass through a recording execution region of the recording head; and a carriage that holds the recording head and the ultraviolet light irradiation unit and moves back and forth in a direction that intersects with the transport direction, wherein the ultraviolet light irradiation unit includes at least one row in which a plurality of LEDs are arranged in the transport direction.

7. The recording apparatus according to claim 4, wherein the failure diagnostic unit is so configured as to perform the failure diagnostics at the time of maintenance operation during the execution of recording operation by the recording head.

* * * * *